US010005529B1

(12) United States Patent
Lueck

(10) Patent No.: US 10,005,529 B1
(45) Date of Patent: Jun. 26, 2018

(54) QUICK RESCUE SURVIVAL KIT

(71) Applicant: Sabrina Patricia Lueck, Ramona, CA (US)

(72) Inventor: Sabrina Patricia Lueck, Ramona, CA (US)

( * ) Notice: Subject to any disclaimer, the term of this patent is extended or adjusted under 35 U.S.C. 154(b) by 41 days.

(21) Appl. No.: 15/391,626

(22) Filed: Dec. 27, 2016

(51) Int. Cl.

| | |
|---|---|
| ***B63C 9/01*** | (2006.01) |
| ***B63B 45/00*** | (2006.01) |
| ***B63C 9/02*** | (2006.01) |
| ***B63B 7/08*** | (2006.01) |
| ***B63B 21/50*** | (2006.01) |
| *B63C 9/00* | (2006.01) |

(52) U.S. Cl.
CPC ..... *B63C 9/21* (2013.01); *B63B 7/08* (2013.01); *B63B 7/085* (2013.01); *B63B 21/50* (2013.01); *B63C 9/02* (2013.01); *B63B 2201/12* (2013.01); *B63B 2231/40* (2013.01); *B63C 2009/007* (2013.01)

(58) Field of Classification Search
CPC ..... B64D 25/20; A47C 15/006; A47C 4/54; B63B 2201/00; B63B 2201/04; B63B 2201/12; B63B 7/08; B63C 9/21; B63C 2009/042
See application file for complete search history.

(56) References Cited

U.S. PATENT DOCUMENTS

| | | | | |
|---|---|---|---|---|
| 2,933,739 | A * | 4/1960 | Ford | B63C 9/02 441/40 |
| 3,019,457 | A * | 2/1962 | Lowery | B63C 9/02 244/905 |
| 4,223,415 | A * | 9/1980 | Patton | B63C 9/04 441/40 |
| 7,357,688 | B2 * | 4/2008 | Ferrara | B63B 7/082 114/345 |
| 2012/0009832 | A1 * | 1/2012 | Rawlings-Lloyd | B63B 45/04 441/36 |

* cited by examiner

*Primary Examiner* — Andrew Polay

(57) ABSTRACT

A visual locator target easy to be seen from the air during the day or night to quickly locate and rescue the user in an emergency or distressed situation. The circular single-layer of bright, neon material used for this target may preferably have a diameter of 25' and be a strong, lightweight material the edge will glow-in-the-dark and inflate for water use making it easy to be seen at night for a quicker rescue. It can be used on land by laying it on the ground and securing it by using the eight anchor hook connectors. It can also be used to float in the water with the inflatable, luminescent circumference, center and cross-sections of the target which includes an inflatable chamber therein. The manual back-up air valve system requires the user to blow their breath into the air valve.

2 Claims, 5 Drawing Sheets

INFLATED TOP AND BOTTOM ANGLE VIEW

TOP AND BOTTOM VIEW
REPLACEMENT SHEET

FLAT, DEFLATED
SIDE VIEW

INFLATED
SIDE VIEW

INFLATED TOP AND BOTTOM
ANGLE VIEW

SURVIVAL KIT ITEMS

CLAIM 4 ILLUSTRATIONS:

A. eight anchor hook connectors;

B. eight anchor hooks;

C. one 2 lb. rubber mallet;

D. one pull-cord;

E. one manual back-up air valve;

F. one ($CO_2$) compressed air cylinder;

G. one swivel-hook;

H. one 10' rope with lead;

I. one lightweight carry bag.

QUICK RESCUE SURVIVAL KIT

DESCRIPTION OF THE INVENTION

A circular, bright-colored piece of lightweight fabric, large enough to be seen by search and rescue aircraft. It can be used on land by simply laying it on the ground, or on water by simply using a ripcord to inflate the center and circumference of the unit keeping it afloat with a self inflating flotation device comprising of at least one elongated inflatable chamber. A new invention for use in an emergency search and rescue situation. A simple, back-to-basic visual locator target easy to be seen from the air during the day or night to quickly locate and rescue the user in an emergency or distressed situation. The circular, single-layer of bright, neon material used for this target may preferably have a circumference of 25' and be 100% strong, lightweight nylon parachute material which can also be used as a temporary shelter if needed until rescued. The vivid neon red-orange color will make it easy to be seen during the day and the neon lime-yellow color in the center and around the edge will glow-in-the-dark and inflate for water use making it easy to be seen at night for a quicker rescue.

Figure 1:
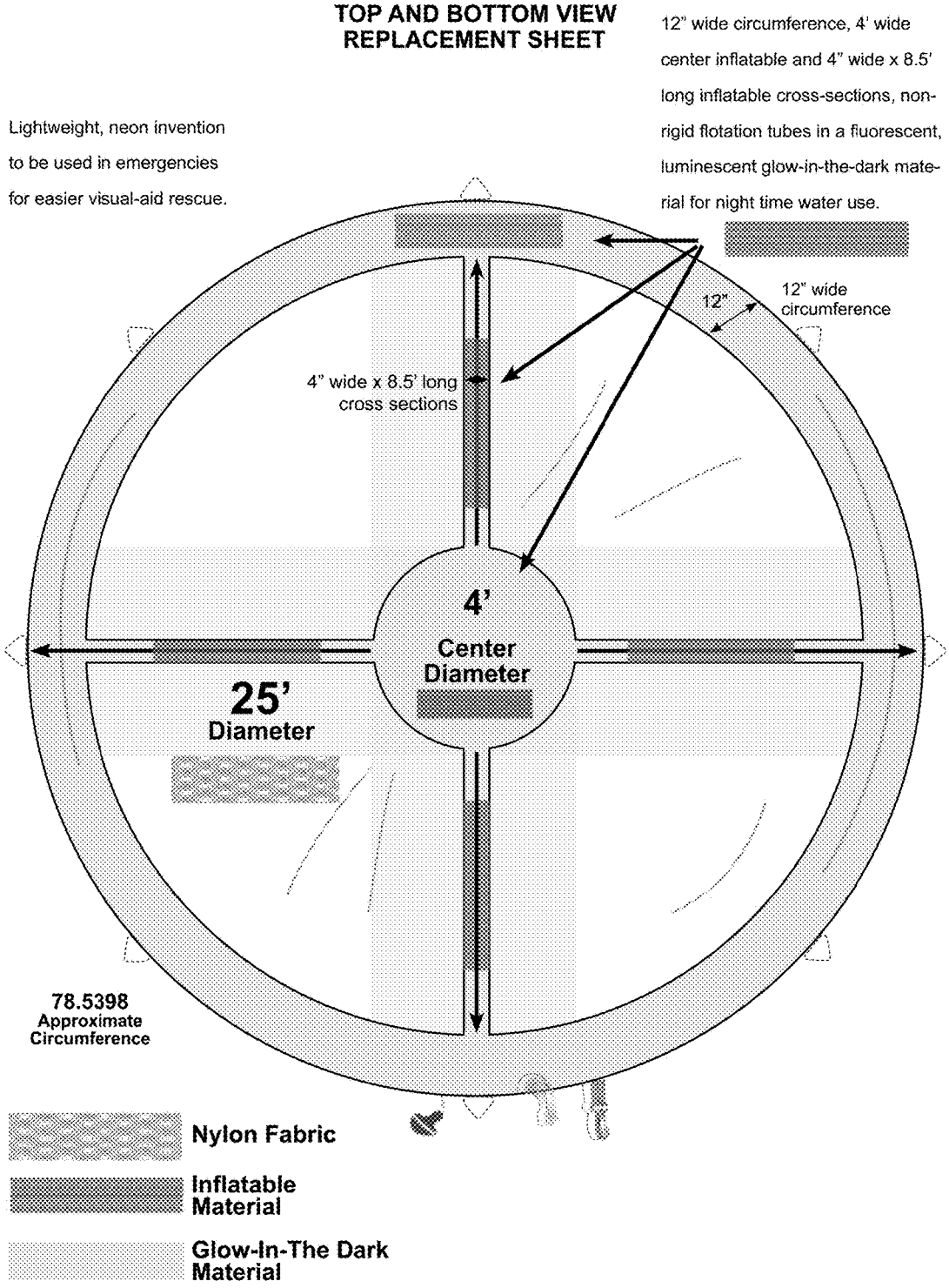
FIG. 1 Shows a top and bottom perspective view of invention. Both sides are a mirror image.
Figure 2:
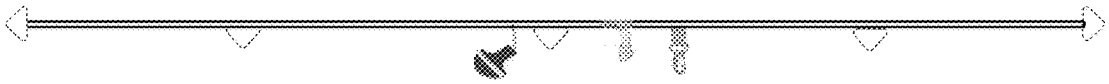
FIG. 2 Shows a flat side view of invention for land use.
Figure 3:
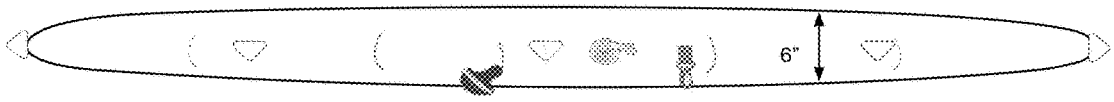
FIG. 3 Shows a side inflated view of invention for water use.
Figure 4:
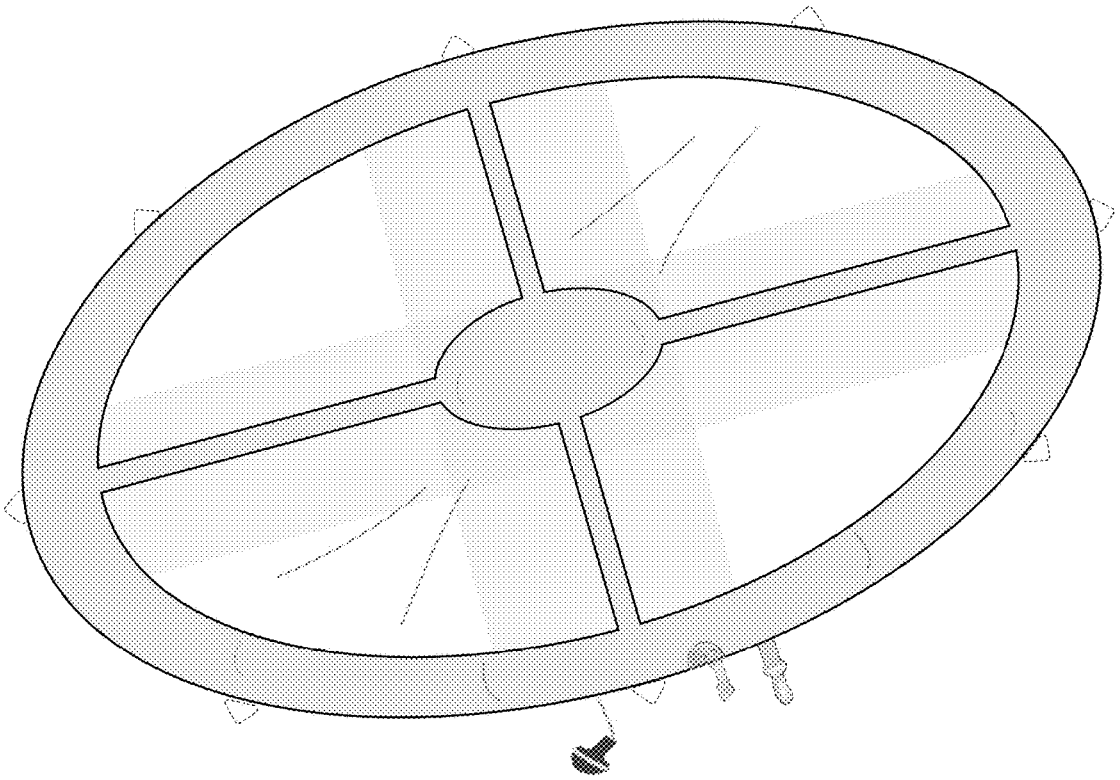
FIG. 4 Shows an inflated top and bottom angle view of invention for water use. Both sides are a mirror image.
Figure 5:
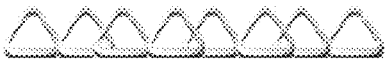
FIG. 5 Shows all remaining items included in the survival kit.
Figure 5:
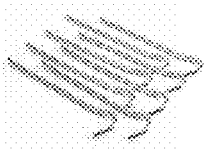
Figure 5:
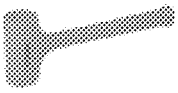
Figure 5:
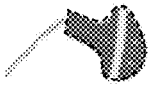
Figure 5:
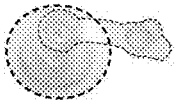
Figure 5:
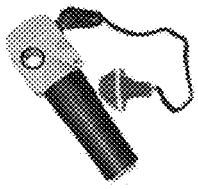
Figure 5:
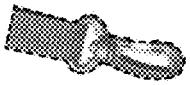
Figure 5:
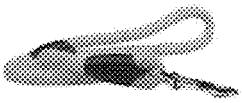
Figure 5:
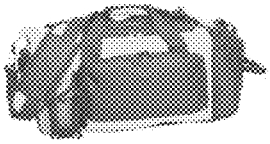

What is claimed is:

1. An inflatable visual marker disc for search and rescue comprising:

an inner inflatable circular disc with a disc diameter, an inflatable tubular ring with an outer diameter, a plurality of inflatable tubular spokes fluidly connecting the circular disc to the inflatable ring, a single layer of fabric extending throughout a plane between the circular disc and the inflatable tubular ring, a plurality of anchor hooks located on the outer diameter of the inflatable tubular ring, wherein each of the inflatable circular disc, inflatable ring, and plurality of inflatable spokes are constructed of a glow-in-the-dark material, and an inflation mechanism on the inflatable tubular ring comprising a rip cord and an air valve for manual inflation.

2. The inflatable visual marker disc of claim 1 wherein the disc diameter is approximately 4 feet and the tubular ring outer diameter is approximately 25 feet.

* * * * *